US005718643A

United States Patent [19]

Wright et al.

[11] Patent Number: 5,718,643

[45] Date of Patent: Feb. 17, 1998

[54] VIBRATION DAMPENING INSERT FOR GOLF CLUBS

[75] Inventors: David E. Wright, Glendale; Bernard A. Clouse, Phoenix; Gary E. Keller, Mesa, all of Ariz.

[73] Assignee: Karsten Manufacturing Corp., Phoenix, Ariz.

[21] Appl. No.: 684,159

[22] Filed: Jul. 19, 1996

[51] Int. Cl.[6] ..... A63B 53/08

[52] U.S. Cl. ..... 473/297; 473/318

[58] Field of Search ..... 473/318–322, 473/332–333, 312, 297, 295–296, 298–299, 520, 521, 523

[56] References Cited

U.S. PATENT DOCUMENTS

| | | | |
|---|---|---|---|
| 2,023,131 | 12/1935 | Gibson | 473/318 |
| 2,782,035 | 2/1957 | East | 473/297 |
| 3,075,768 | 1/1963 | Karns | 473/297 |
| 4,056,267 | 11/1977 | Krieger | 473/520 |
| 4,082,273 | 4/1978 | Ellzey | 473/523 |
| 4,090,711 | 5/1978 | Amato et al. . | |
| 5,277,423 | 1/1994 | Artus et al. . | |
| 5,294,119 | 3/1994 | Vincent et al. . | |
| 5,297,791 | 3/1994 | Negishi et al. . | |
| 5,316,298 | 5/1994 | Hunin et al. . | |
| 5,362,046 | 11/1994 | Sims et al. . | |
| 5,366,222 | 11/1994 | Lee | 473/333 |
| 5,454,562 | 10/1995 | Sommer | 473/523 |

*Primary Examiner*—Sebastiano Passaniti
*Assistant Examiner*—Stephen L. Blau
*Attorney, Agent, or Firm*—Darrell F. Marquette

[57] ABSTRACT

A vibration dampening insert for use in golf clubs includes a plug member located inside a shaft of a golf club. The plug member has a plurality of cavities formed therein, and a plurality of spherical weight members are disposed in the plurality of cavities. The plug member is made of an elastomeric material, and the spherical weight members consist of steel balls. The vibration dampening insert dampens vibration resulting when a club head of a golf club impacts a golf ball so that vibration is prevented from being transmitted to a golfer who is swinging the golf club.

10 Claims, 1 Drawing Sheet

VIBRATION DAMPENING INSERT FOR GOLF CLUBS

BACKGROUND OF THE INVENTION

This invention relates generally to golf clubs and, in particular, to a vibration dampening insert for golf clubs.

Typically, golf clubs include an elongated shaft, a club head attached to a lower end of the shaft, and a grip attached to an upper end of the shaft. It is well known that golf clubs vibrate as a result of the club head impacting a golf ball. When a golfer swings a golf club so that the club head impacts a golf ball at the club head's center of gravity, no unpleasant vibrations are produced. However, if the club head impacts a golf ball at a location that is spaced from the center of gravity, undesirable vibrations are transmitted through the club head, the shaft and the grip to the golfer's hands. These undesirable vibrations may cause discomfort for the golfer.

U.S. Pat. No. 5,277,423 to J. P. Artus discloses a golf club including a shaft, a club head secured to one end of the shaft, and a grip secured to another end of the shaft. A vibration damping device is fixed to the shaft at a location that is about one-third the length of the shaft from the club head. The vibration damping device includes a rigid outer sleeve surrounding an elastic inner sleeve that is glued to the shaft. The outer sleeve may be made from an aluminum alloy, and the inner sleeve could be made of material such as rubber. The inner and outer sleeves may be bonded together by a suitable adhesive.

U.S. Pat. No. 5,294,119 to Vincent et al discloses a vibration damping device for golf clubs that is located on the shaft adjacent the club head or the grip. In one embodiment, the Vincent et al device consists of an outer ring made of rigid material such as metal and an intermediate layer made of flexible material of the viscoelastic type. The intermediate layer has an inner surface bonded to the outside of the shaft and an outer surface bonded to the inside of the outer ring. In another embodiment, the Vincent et al device consists of the intermediate layer having its outer surface bonded to the inside of the shaft while the inner surface of the intermediate layer is bonded to the outside of an inner ring made of metal.

U.S. Pat. No. 5,362,046 to S. C. Sims discloses a vibration damping device made of elastomeric material for use in implements such as golf clubs, baseball bats, and tennis rackets. In a golf club, the Sims device is installed in the end of the shaft opposite the club head and includes a base with a tapered nose. The base supports a pair of circular heads on longitudinally aligned stems. The heads and the stems oscillate back and forth relative to the shaft to dampen vibration in the golf club. The vibration damping device is enclosed in the shaft by a threaded cap.

SUMMARY OF THE INVENTION

The present invention provides a vibration dampening insert for use in a golf club wherein the golf club includes an elongated shaft, a club head attached to one end of the shaft, and a grip mounted on the other end of the shaft. The vibration dampening insert is adapted for dampening vibration resulting when the club head impacts a golf ball so that vibration is prevented from being transmitted to the grip.

The vibration dampening insert comprises a plug member located inside the shaft with at least one cavity formed therein, and a weight member disposed in the cavity in the plug member. In the preferred embodiment of the vibration dampening insert, the plug member has a plurality of cavities, and a plurality of spherical weight members am disposed in the plurality of cavities. The plug member may be made of an elastomeric material, and the spherical weight members may be steel balls.

DESCRIPTION OF THE PREFERRED EMBODIMENT

Figure 1:
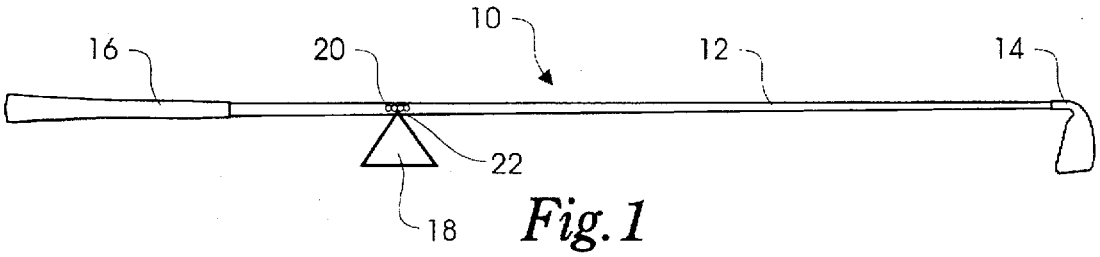
FIG. 1 is a side elevational view of a golf club incorporating a vibration dampening insert according to the preferred embodiment of the present invention.
Figure 5:
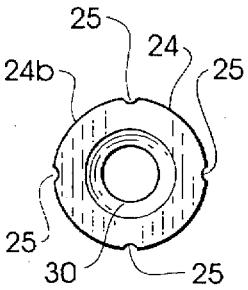
FIG. 5 is an end view of the vibration dampening insert.
Figure 3:
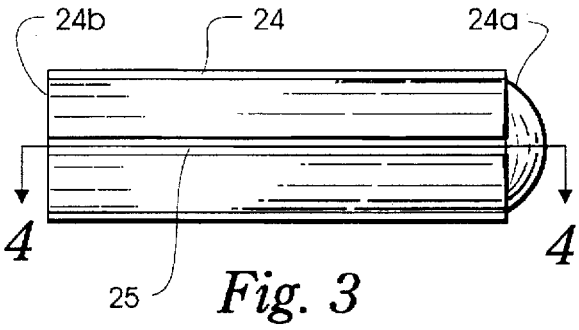
FIG. 3 is side elevational view of the vibration dampening insert.
Figure 4:
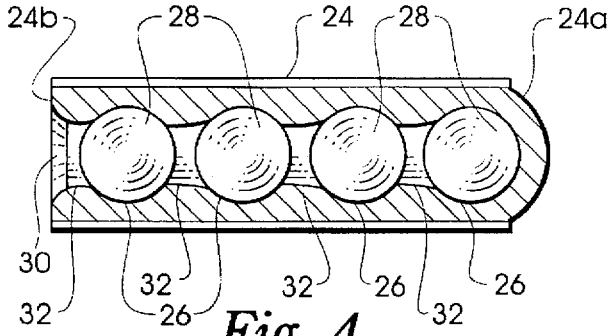
FIG. 4 is a cross sectional view taken along lines 4—4 in FIG. 3.
Figure 7:
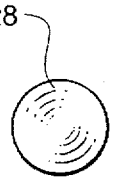
FIG. 7 is a side view of another part of the vibration dampening insert.
Figure 6:
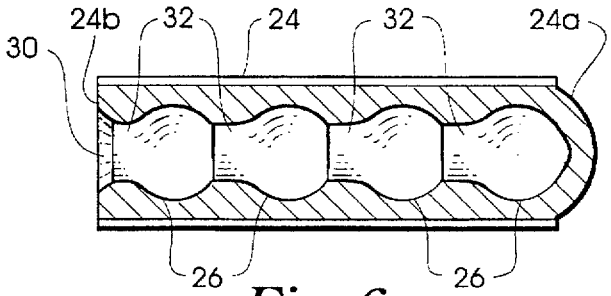
FIG. 6 is a cross sectional view of one pad of the vibration dampening insert.
Figure 2:
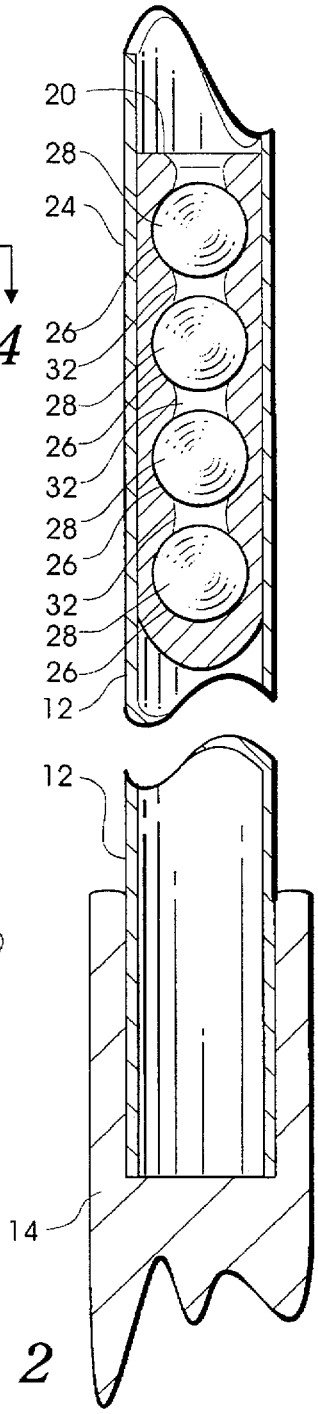
FIG. 2 is an enlarged sectional view of a portion of the golf club shown in FIG. 1.

Referring to FIG. 1, a golf club 10 includes an elongated shaft 12, a club head 14 attached to one end of the shaft 12, and a grip 16 mounted on the other end of the shaft 12. The golf club 10 is balanced on a fulcrum 18 for measuring its "swing weight". The fulcrum 22 is part of a conventional device, such as shown in U.S. Pat. No. 3,577,771 to Karsten Solheim, that is used to measure "swing weight" of golf clubs. A vibration dampening insert 20 is disposed inside the shaft 12 at a location 22 (i.e. a balance point) that does not affect the balancing of the golf club 10 on the fulcrum 18. Since the vibration dampening insert 20 is disposed at the balance point 22, the "swing weight" of the golf club 10 is not altered.

The vibration dampening insert 20 includes a plug member 24 made of elastomeric material such as rubber secured inside the shaft 12 by a suitable adhesive. U-shaped grooves 25 formed in an outer surface of the plug member 24 facilitate insertion of the plug member 24 into the shaft 12. The plug member 24 has a series of cavities 26 formed therein for receiving a plurality of spherical weight members 28 such as steel balls. The cavities 26 are aligned longitudinally of the plug member 24. The plug member 24 has a closed end 24*a* and an open end 24*b*, and the spherical weight members 28 are pushed into the plug member 24 via a circular opening 30 in the open end 24*b*. The cavities 26 are connected to each other and to the circular opening 30 by generally cylindrical passages 32. It should be noted that the passages 32 are slightly distorted when the insert 20 is disposed in the shaft 12 but they are of sufficient length to maintain adequate spacing between the spherical weight members 28.

In the preferred embodiment of the vibration dampening insert 20, the plug member 24 has a Shore A hardness of 15 and four spherical members 28 are utilized. The Shore A hardness of the plug member 24 may be adjusted within a range of 3 to 100 and the number of spherical members 28 may be increased or decreased to achieve the desired vibration dampening. The plug member 24 has a length of about 1.7 inches and an outer diameter of about 0.5 inch. Each spherical weight member 28 has a diameter of about 0.3 inch and weighs about 2 grams. The insert 20 has a total weight of about 11 grams.

In use, when the golf club 10 is swung by a golfer so that the club head 14 impacts a golf ball (not shown), vibration results and is transmitted from the club head 14 into the shaft 12. Vibration transmitted into the shaft 12 is dampened by the insert 20. Since vibration is dampened by the insert 20, it is not transmitted to the grip 16 and thus is not transmitted to the golfer who is holding the grip 16.

It is understood that the plug member 24 is preferably made of an elastomeric material such as rubber while the spherical weight members 28 are preferably made of another material such as steel that is denser than the elastomeric material of the plug member 24.

It will be understood that the spherical weight members 28 may be replaced by weight members of alternative shapes such as cylindrical weight members or cubic weight members.

What is claimed is:

1. A vibration dampening insert for use in a golf club wherein the golf club includes an elongated shaft, a club head attached to one end of said shaft, and a grip mounted on the other end of said shaft, said vibration dampening insert being adapted for dampening vibration resulting when said club head impacts a golf ball, said vibration dampening insert comprising:

a plug member located inside said shaft, said plug member having a plurality of individual cavities formed therein; and a plurality of individual weight members disposed in said plurality of individual cavities, each cavity of said plurality of individual cavities containing only one individual weight member.

2. The vibration dampening insert of claim 1, wherein said plug member is made of an elastomeric material.

3. The vibration dampening insert of claim 2, wherein said plug member has a Shore A hardness in a range of 3 to 100.

4. The vibration dampening insert of claim 3, wherein said plug member has a Shore A hardness of 15.

5. The vibration dampening insert of claim 2, wherein said plurality of individual weight members comprises a plurality of steel balls.

6. The vibration dampening insert of claim 1, wherein each of said plurality of individual weight members has a diameter of about 0.3 inch and a weight of about 2 grams.

7. The vibration dampening insert of claim 1, wherein said plurality of individual weight members comprises four spherical weight members.

8. The vibration dampening insert of claim 1, wherein said plug member has a length of about 1.7 inches and an outer diameter of about 0.5 inch.

9. The vibration dampening insert of claim 1, wherein said plug member and said plurality of individual weight members have a total weight of about 11 grams.

10. The vibration dampening insert of claim 1, wherein the cavities of said plurality of cavities are aligned longitudinally with respect to said plug member.

* * * * *